United States Patent [19]

Morgan et al.

[11] Patent Number: 4,567,678

[45] **Date of Patent: * Feb. 4, 1986**

[54] ORTHOPEDIC SHOE

[76] Inventors: R. Dean Morgan, 414 Stiles, Midlothian, Tex. 76065; Donald M. Mauldin, 3631 Potomac, Dallas, Tex. 75205; Thomas L. Taylor, 872 Russell, Bedford, Tex. 76021

[ * ] Notice: The portion of the term of this patent subsequent to Nov. 15, 2000 has been disclaimed.

[21] Appl. No.: 255,828

[22] Filed: Apr. 20, 1981

Related U.S. Application Data

[60] Division of Ser. No. 214,752, Dec. 9, 1980, Pat. No. 4,414,759, which is a continuation-in-part of Ser. No. 141,966, Apr. 21, 1980, abandoned.

[51] Int. Cl.[4] ..... A43B 3/12

[52] U.S. Cl. ..... 36/110; 36/11.5; 128/83.5

[58] Field of Search ..... 36/11.5, 110, 1, 1.5, 36/103, 7.3, 32 R; 128/82, 83, 83.5

[56] References Cited

U.S. PATENT DOCUMENTS

| | | | |
|---|---|---|---|
| 2,278,626 | 4/1942 | Vasko . | |
| 2,317,020 | 4/1943 | Banister . | |
| 2,341,963 | 2/1944 | Telson . | |
| 2,404,083 | 7/1946 | Murray . | |
| 2,423,354 | 7/1947 | Vanhoesen . | |
| 2,614,340 | 10/1952 | Larkin . | |
| 2,725,648 | 12/1955 | Kirk et al. . | |
| 2,733,522 | 2/1956 | Murray . | |
| 2,762,367 | 9/1956 | Rubin . | |
| 2,810,213 | 10/1957 | Jonas . | |
| 2,875,752 | 3/1959 | Lovich . | |
| 2,884,717 | 5/1959 | Goldberg . | |
| 3,044,463 | 7/1962 | Cool . | |
| 3,307,536 | 3/1967 | Blosser . | |
| 3,545,104 | 12/1970 | Laurie . | |
| 3,566,487 | 3/1971 | Beightol . | |
| 3,584,402 | 6/1971 | Silverman . | |
| 3,613,674 | 10/1971 | Volz . | |
| 3,633,573 | 1/1972 | Lipson . | |
| 3,802,424 | 4/1974 | Newell | 36/110 |
| 3,905,135 | 9/1975 | Debusk . | |
| 4,057,056 | 11/1977 | Payton . | |
| 4,178,925 | 12/1979 | Hirt . | |
| 4,200,997 | 5/1980 | Scheinhaus . | |

OTHER PUBLICATIONS

Clawson Rocker Orthopedic Shoe Training Manual by Dr. Jacqueline Perry, M.D. and Carolyn P. Clawson, Copyright 1979.

Clarks of England advertisement, Copyright 1982.

*Primary Examiner*—Werner H. Schroeder

*Assistant Examiner*—Steven N. Meyers

*Attorney, Agent, or Firm*—Michael A. O'Neil

[57] ABSTRACT

An orthopedic shoe (88,116) and postoperative shoe (10) are disclosed. The postoperative shoe (10) maintains the foot of the wearer supported on a planar inner sole (12) without flexure of the foot while permitting the shoe (10) to roll, imitating the natural motion of the foot during walking. This permits the wearer to walk in a normal manner while controlling the flexure of the foot to permit the foot to recover from surgery or prevent aggravation of a medical condition. Straps (66,68 and 72–78) are provided to adjustably position the foot on the inner sole (12) so that the metatarsal point (20) of the foot is positioned forward of the fulcrum (16). When the wearer is standing, the weight is distributed between the heel (18) and metatarsal point (20) so that the planar portion (46) of the shoe (10) contacts the walking surface. When weight shifts toward the metatarsal point (20) as in walking, the shoe (10) rolls on the curved portion (48). The curved portion (48) has a generally uniform radius selected to provide a smooth transition from the planar portion (46) to the curved portion (48). The same principles may be applied to shoes (88,116) for use with a normal foot. In one shoe (88), the positioning of the metatarsal point (108) forward of the fulcrum (104) initiates a rolling motion of the shoe (88) on the curved surface (102) to simulate the natural motion of the foot in walking. The rolling motion provides a continuous change of pressure points on the forefoot supporting the body weight. In another shoe (116) for use with a normal foot, the rolling motion is on a curved portion (126) consisting of three curves of progressively shorter radii which are blended to form a smooth curve. The three radii permit the inner sole (118) of the shoe (116) to remain in contact with the heel of the foot during the end of the stance phase when the heel is lifted at increasing velocity.

16 Claims, 8 Drawing Figures

ORTHOPEDIC SHOE

This is a division of application Ser. No. 214,752 filed Dec. 9, 1980 which is now U.S. Pat. No. 4,414,759, which is a continuation-in-part of application Ser. No. 141,966, filed 4/21/80 now abandoned.

TECHNICAL FIELD

This invention relates to an orthopedic shoe, and more particularly to a postoperative shoe that simulates the natural motion of a foot in walking or an orthopedic shoe for simulating the natural motion of the foot.

BACKGROUND ART

A number of medical problems involving the foot or lower leg may only be resolved or even maintained in a stable condition by ensuring that the sole of the foot is maintained on a flat or planar surface permitting little or no flexure of the foot. In particular, such medical problems as postoperative recuperation, diabetic ulcers and arthritis may require the sole of the foot to be maintained on a planar surface and unflexed.

In the past, footwear has been provided which maintains the sole of the foot on the planar surface of a rigid platform defining an inner sole. A planar outer sole is defined on the bottom side of the platform which contacts the ground or walking surface and is generally parallel to the inner sole contacting the foot. While maintaining the foot in the unflexed state and being adequate for a standing position, the rigidity and planar outer sole of the footwear inhibits the natural walking motion of the foot and lower leg. The natural motion or striding action of a normal foot in walking is a cycle where, typically, the heel of the foot first contacts the ground, with the weight of the body being shifted forward along the foot until it finally rests on the ball or metatarsal point of the foot with the heel raised off the walking surface to propel the body forward. This footwear provides no means to simulate this cycle. The wearer of such footwear is forced to either lift the foot completely from the ground to walk or slide his foot sideways, forcing the wearer to an unnatural and tiring manner of walking.

In addition, the footwear or shoes worn by a person having a normal and healthy foot also inhibits the natural motion and striding action of the wearer when walking. Most footwear is flexible so that the foot deforms the sole of the shoe in a manner that conforms with the flexure of the sole of the foot. However, shear stresses are developed between the interface of the skin of the foot and the interior of the shoe since the foot is somewhat mobile within the shoe. As the heel is lifted off the ground in the normal walking motion, the weight of the body is supported on the meta heads, causing prolonged localized areas of stress in the metatarsal region which tends to sensitize these areas. The necessity to flex the sole of the shoe requires energy input from the wearer and may result in fatigue or localized stress areas on the foot.

A need has thus arisen for a postoperative shoe permitting the wearer to walk with a natural motion while maintaining the foot unflexed. Additionally, a need has arisen for an orthopedic shoe which immobilizes the foot in the shoe while simulating the normal motion of walking to provide greater comfort and less energy expenditure.

DISCLOSURE OF THE INVENTION

In accordance with the invention, a shoe for wear on a foot when walking on a surface is provided. The shoe comprises an inner sole having a first support face for supporting the heel of the foot and a second support face for supporting the metatarsal point of the foot. An outer sole is provided beneath and spaced from the inner sole for contacting the surface and has a first contact face beneath the first support face and a second contact face having a fulcrum between said first and second support faces and extending from said fulcrum forwardly and toward said inner sole for contacting the surface, the first contact face and fulcrum contacting the surface when standing on the foot. The metatarsal point of the foot is supported forward of the fulcrum for initiating a rolling motion of the shoe on the second surface as weight is shifted to the metatarsal point of the foot in walking. Means are provided for positioning and maintaining the foot supported on the first and second support faces of the inner sole.

In accordance with another aspect of the invention, a post op shoe for wear on a foot when walking on a surface is provided. The post op shoe includes a rigid platform having a substantially planar top surface and a bottom surface formed by a first portion and a second portion. The first and second portions intersect to form a fulcrum with the first portion extending from the fulcrum generally parallel the top surface and the second portion extending from the fulcrum towards the top surface. The post op shoe further includes a resilient inner sole secured to the top surface for cushioning the foot and a nonskid material secured to the bottom surface for contacting the walking surface. The post op shoe further includes means for positioning and securing the post op shoe on the foot with the metatarsal point of the foot positioned forward of the fulcrum and above the second so that when the wearer is standing, the foot is supported on a walking surface through the first portion and when the wearer shifts weight onto the metatarsal point in walking a rolling motion of the post op shoe on the second portion is initiated to simulate natural walking motion while maintaining the foot unflexed.

In accordance with yet another aspect of the invention, an orthopedic shoe for wear on a foot for walking on a surface is provided. The shoe includes a contoured inner sole for supporting the foot at least at the heel and metatarsal point. The shoe further includes an outer sole beneath and spaced from the inner sole for contacting the surface at a first face beneath the heel and at a second face having a fulcrum between the heel and metatarsal point and extending forward from the fulcrum and toward the inner sole, the metatarsal point of the foot is supported forward of the fulcrum for initiating a rolling motion of the shoe on the second face as the weight of the wearer shifts forward to the metatarsal point when walking. The shoe further includes a shoe upper to position and maintain the shoe on the foot. The inner and outer soles are rigid to immobilize the foot in the shoe as the wearer walks with the rolling action of the shoe on the second face simulating the natural motion of the foot.

BRIEF DESCRIPTION OF THE DRAWINGS

A more complete understanding of the invention and its advantages will be apparent from the following Detailed Description taken in conjunction with the accompanying drawings in which.

DETAILED DESCRIPTION

Figure 1:
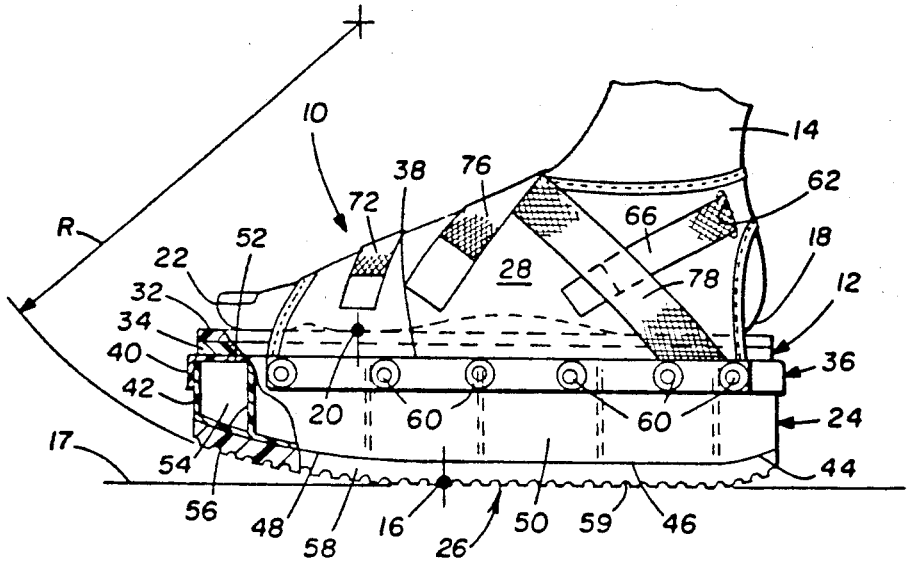
FIG. 1 is a side view of a post op shoe forming the first embodiment of the present invention.
Figure 2:
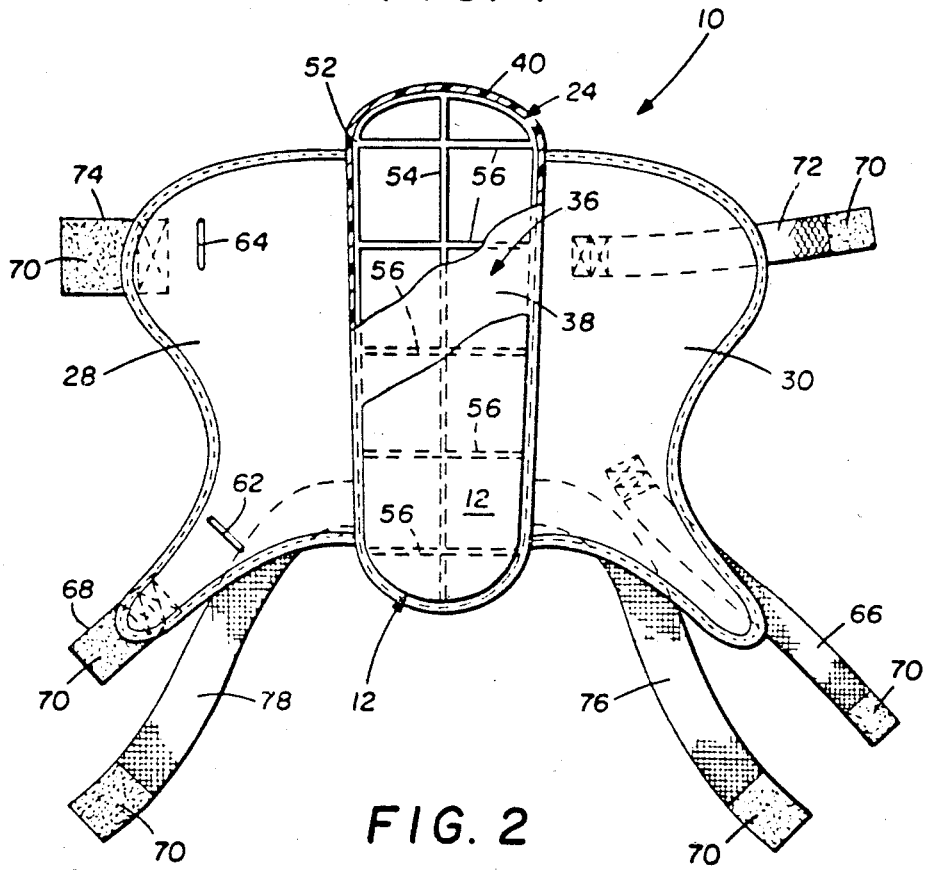
FIG. 2 is a top view of the post op shoe.
Figure 3:
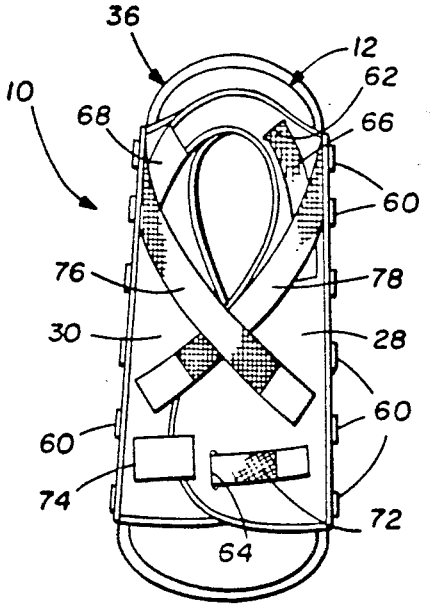
FIG. 3 is a top view of the post op shoe of the present invention showing the positioning of the straps.

FIGS. 1 through 3 illustrate a postoperative or post op shoe 10, forming the first embodiment of the present invention. The purpose of the post op shoe 10 is to provide a relatively rigid planar inner sole 12 for supporting and preventing flexure of the foot 14 of the wearer while permitting the shoe 10 to roll on the shoe outer sole forward of fulcrum 16 on walking surface 17. Fulcrum 16 extends across the entire width of the shoe 10. When the wearer shifts his weight from the heel 18 to the metatarsal point or ball of the foot 20 and toes 22, rolling motion of the shoe 10 on the outer sole forward of fulcrum 16 is initiated to provide a natural walking motion while maintaining the foot 14 on the flat inner sole 12. While the postoperative shoe 10 may be employed after a surgical procedure on the foot 14, the post op shoe 10 may also be used in any situation where the foot must be kept unflexed or on a flat surface to cure an ailment or prevent the ailment from increasing in severity. Examples of such situations are diabetic ulcers induced at points of stress in diabetic patients and patients suffering from arthritis aggravated by high stress concentrations on a portion of the foot. It will be understood that although the post op shoe 10 is an orthopedic shoe, the term orthopedic shoe is defined broadly for purposes of this disclosure to include any footwear capable of alleviating any ailment of the foot or preventing an ailment from developing, including discomfort induced by the footwear itself.

The foot 14 of a human goes through a well-known natural cyclical motion for every step taken. The cycle generally includes moving one foot forward of the other while the body weight is supported on the rearward foot, initially contacting the walking surface with the rear of the heel of the forward foot, rolling the forward foot about the heel until the metatarsal point or ball of the foot contacts the walking surface while the body pivots about the ankle and the body weight is shifted to the forward foot from the rearward foot, lifting the heel of the forward foot off the walking surface by flexing the foot so that the entire weight of the body rests on the metatarsal point and the toes of the foot and moving the body forward off the metatarsal point and toes as the rearward foot is brought forward of the forward foot to undergo a similar cycle. In this manner, a person may run, jog, stroll or move in any other similar fashion all of which are encompassed in the generic term walking.

It is clear that the medical necessity to maintain the sole of foot 14 on a flat surface and unflexed prevents the foot from fully completing the cycle described above. The purpose of the post op shoe 10 is to permit the foot to be maintained unflexed on a planar surface while providing an action similar to the cycle above to allow the patient to walk as naturally as possible.

The post op shoe 10 comprises an inner sole 12, a generally rigid platform 24, an outer sole 26 and flexible side flaps 28 and 30 having straps secured thereon forming the uppers of shoe 10. Side flaps 28 and 30 are used for positioning and maintaining the shoe 10 on the foot 14 by enclosing or surrounding the foot.

In the preferred construction of the post op shoe 10, the inner sole 12 includes a top layer 32 comprised of a resilient closed cell cross linked polyethylene foam such as that marketed under the trademark Plastazote and a bottom layer 34 comprising sponge rubber. The polyethylene foam forming the top layer 32 preferably has the quality known as number one or medium in the art. The sponge rubber forming the bottom layer 34 is preferably of medium density. Although these materials are preferred, any other material having a degree of resiliency sufficient to avoid discomfort to the wearer may be substituted. The materials used in inner sole 12 preferably are of a type that will not permit cultures to grow thereon.

The platform 24 is preferably constructed from two pieces of nontoxic moldable plastic material. The top piece 36 is formed into a generally planar surface 38 having a lip 40 formed at the outer perimeter thereof. The bottom piece 42 has a formed bottom surface having a curved heel portion 44, a planar portion 46 and a curved portion 48. Vertical sides 50 extend upwardly from the outer edges of planar and curved portions 44, 46 and 48 to edge 52. Longitudinal support member 54 and lateral support members 56 interconnect the bottom surface and vertical sides 50 of the bottom piece 42 to provide great rigidity at a minimum weight. In limited quantities, the top piece 36 and bottom piece 42 may be vacuum molded. For larger quantities, the pieces 36 and 42 are preferably injection molded. When shoe 10 is assembled, the pieces 36 and 42 are mated so that the lip 40 is adjacent the vertical sides 50 and the edge 52 contacts the under surface of the bottom surface. The pieces 36 and 42 may be permanently bonded in this position by any suitable adhesive. Any other semi-rigid material capable of being formed in the desired shape could be substituted for the plastic of platform 24, in particular wood.

A nonskid outer sole 58 is provided to protect the wearer of shoe 10 from slipping on the walking surface. A series of grooves or corrugations 59 forms a tread on sole 58 to further protect the wearer from slipping. The nonskid outer sole 58 is preferably $\frac{1}{4}$ to $\frac{3}{8}$ inch thick and comprises a flexible material that is flexed to conform to the shape of the bottom surface of the platform 24. The top layer 32 may be secured to bottom layer 34 by any suitable adhesive. The bottom layer 34 and nonskid outer sole 58 may also be secured to platform 24 by any suitable adhesive.

The flexible side flaps 28 and 30 are shown secured to the platform 24 by means of rivets 60. Any other suitable means for attaching side flaps 28 and 30 may be substituted provided that the side flaps 28 and 30 are secured with sufficient strength to position and maintain the shoe 10 on foot 14 when walking. Flaps 28 and 30 preferably include material to which the male portion of the fastening surface marketed under the trademark Velcro, may be attached. The male portion of a Velcro surface includes a plurality of hook members and may engage material comprising either the female portion of a Velcro surface which comprises a plurality of loops on which the hooks may fasten, or a cloth, flannel or other material having threads to which the hooks may be fastened. Flaps 28 and 30 may either have strips of the female portion of a Velcro surface fastened at selected locations thereto or comprise material suitable for receiving the hooks of the male portion. The post op shoe 10 as illustrated in FIGS. 1–6 includes side flaps 28 and 30 formed of suitable material for receiving the hooks of a male Velcro surface. However, if strips of female Velcro or other suitable attachment means are provided, the side flaps 28 and 30 may be of canvas, leather or other materials. Slots 62 and 64 are formed in flexible side flap 28 as shown in FIG. 2. An inner heel strap 66, secured to the heel portion of flexible side flap 30, is sized to pass through slot 62. An outer heel strap 68 is secured to the heel portion of flexible side flap 28. A male Velcro surface 70 is provided at the unsecured end of both straps 66 and 68.

An inner front strap 72 is similarly sized to pass through slot 64 and is secured at one end to flexible side 30. An outer front strap 74 is secured at one end to flexible side 28. Both straps 72 and 74 have male Velcro surfaces 70 at the unsecured ends thereof. The foot 14 is positioned on the shoe so that the metatarsal point 20 lies forward of fulcrum 16 by means of front straps 72 and 74. The inner front strap 72 is passed through slot 64 and both front straps 72 and 74 are tightened to secure the shoe 10 to the foot 14 with the desired amount of force and then secured to the flexible sides 28 and 30, respectively, by male Velcro surface 70. The shoe 10 may be maintained on foot 14 by means of heel straps 66 and 68 by inserting inner heel strap 66 through slot 62 and wrapping strap 66 and 68 around the heel, securing the straps to side flaps 28 and 30, respectively, in the desired position by male Velcro surface 70. A line or mark may be provided on the inner sole 12 of the shoe 10 to indicate the proper location for the metatarsal point 20.

Cross straps 76 and 78 may also be provided for ensuring the positioning and maintenance of shoe 10 on the foot 14, however, it has been found that the use of the cross straps 76 and 78 is not necessary in all instances. Each cross strap 76 and 78 is secured at one end to the heel portion of platform 24 and has a male Velcro surface 70 at the opposite end. The cross straps 76 and 78 have a length sufficient to extend forward of the ankle and be fastened to the side flap opposite its point of attachment as illustrated in FIGS. 1 and 3.

In the use of the shoe 10, the straps 66, 68 and 72 through 78 are adjusted so that the foot 14 of the wearer is positioned on inner sole 12 with the metatarsal point 20 positioned ahead of or forward towards the toe of shoe 10 relative to the fulcrum 16. When the foot 14 is so positioned, the wearer may shift the weight of his body onto the metatarsal point 20 thereby causing the shoe 10 to pivot about fulcrum 16 and initiating a rolling motion of shoe 10 on curved portion 48 to imitate or substitute for the natural motion of walking. This pivoting and rolling action permits lifting the heel 18 off the walking surface while maintaining the foot 14 unflexed and on a flat surface. Curved heel portion 44 is provided to imitate or substitute for the pivotal motion about the heel 18 that occurs in normal walking.

Although the metatarsal point 20 is positioned forward of the fulcrum 16, the separation is controlled so that, when the wearer is standing and distributing body weight through both the heel 18 and metatarsal point 20, the shoe 10 rests on the planar portion 46. Planar portion 46 extends from the heel of the shoe forward to fulcrum 16 and provides a secure platform for the wearer to stand on.

In the preferred construction, the curved portion 48 is provided with a uniform radius of curvature R. The radius R is selected to provide a natural transition from supporting the weight of the body on planar portion 46 to the curved portion 48 as the shoe 10 pivots about fulcrum 16 and rolls onto curved portion 48. At the instant the weight of the body is shifted to the metatarsal region it initiates a rolling motion of the shoe 10 from the fulcrum 16 along the curved portion 48. As the center of mass of the body continues to move anterior or forward of the weight bearing portion of the foot, the shoe 10 continues to roll along the curved portion 48 until the foot is lifted off the ground. As the shoe 10 rolls along the curved portion 48, the portion of the foot supporting the body weight is continuously changing. This avoids prolonged concentrations of stress on any part of the forefoot, particularly in the metatarsal region. In one specific embodiment of the invention, a radius R of about $7\frac{1}{4}$ inches proved to be highly satisfactory.

The provision of adjustable foot straps such as straps 72 and 74 permits the post op shoe 10 to be used with a range of foot sizes. Although the straps may be almost infinitely adjustable, the portion of the inner sole 12 of post op shoe 10 forward of the fulcrum 16 must be of sufficient length to support the toes 22 of the foot 14. In addition, the length of the inner sole 12 and platform 24 forward of fulcrum 16 should not extend to a point where either member would contact the walking surface as the shoe 10 pivots about fulcrum 16 before the degree of rolling motion on curved portion 48 equals the normal degree of pivotal motion about the metatarsal point 20 of a foot in walking. It has been found that the entire range of human foot sizes encountered in normal circumstances will be accommodated by only four sizes of post op shoe 10.

It should be understood that, although a uniform radius curved portion 48 having radius R is most desirable, it is not necessary to achieve a simulation of the natural motion of a foot as a post op shoe 10 pivots about fulcrum 16 and rolls on curved portion 48. The curved portion 48 may have any curved or linear shape desired provided that the portion 48 forward of fulcrum 16 lies above the plane defined by the planar portion 46 and fulcrum 16 of the post op shoe 10.

Figure 4:
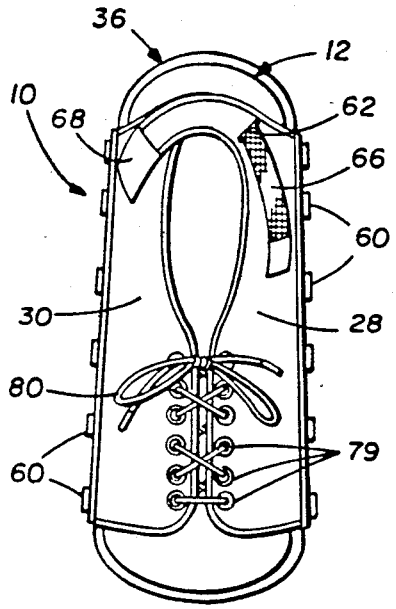
FIG. 4 is a top view of a first modification of the post op shoe having shoe laces.
Figure 5:
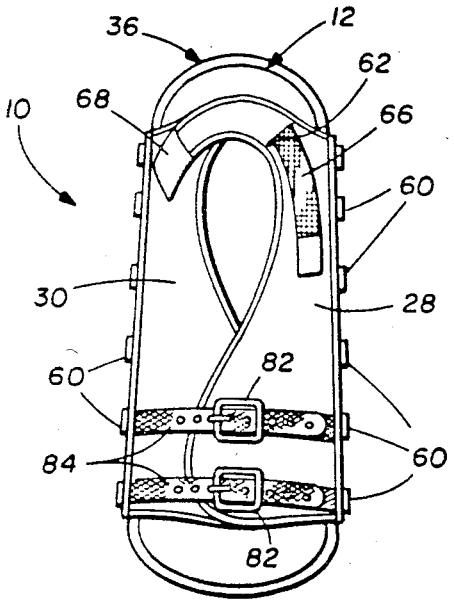
FIG. 5 is a top view of a second modification of the post op shoe having buckles.

Although the preferred construction of post op shoe 10 includes front and cross straps 72 through 78 as discussed above for positioning the post op shoe 10 on the foot 14, other means may be substituted for these straps. In particular, a first modification of the post op shoe 10 is illustrated in FIG. 4. The flexible side flaps 28 and 30 are provided with eyelets 79 for receiving shoe lace 80 as shown. In the first modification, the flexible side flaps 28 and 30 may be formed of canvas, leather or any other material suitable for receiving eyelets 79. The eyelets 79 and shoe lace 80 substitute for straps 72 through 78 and perform a similar function in positioning foot 14 on shoe 10 so the metatarsal point 20 is in the proper position forward of fulcrum 16. The heel straps 66 and 68 are retained in the first modification to maintain foot 14 on shoe 10.

The side flaps 28 and 30 are either formed of suitable material or have material attached thereto at selected locations for receiving male Velcro surfaces 70.

In the second modification of the post op shoe 10, buckles 82 and straps 84 are provided. The buckles 82 and straps 84 again substitute for straps 72 through 78 and perform a similar function in positioning foot 14. Again, heel straps 66 and 68 are retained. The side flaps 28 and 30 are also formed of a material or have material attached thereto at selected locations suitable for securing male Velcro surface 70 thereto.

Figure 6:
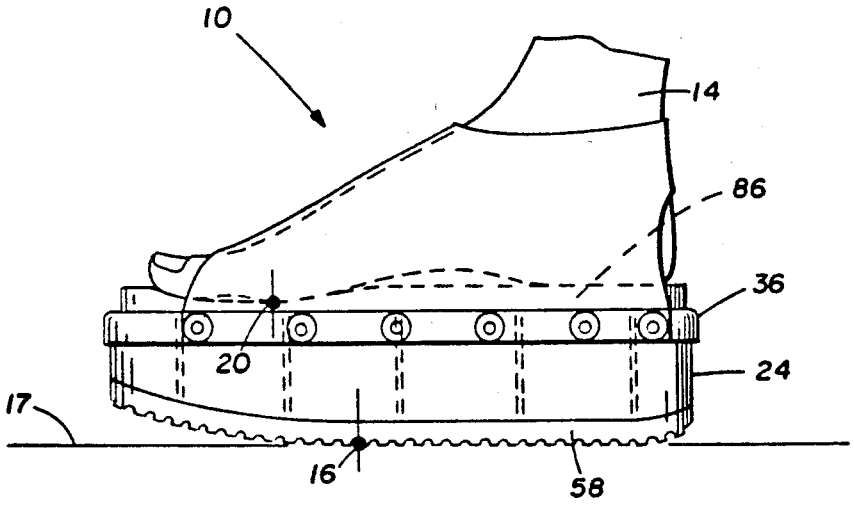
FIG. 6 is a side view of a third modification of the post op shoe having a slightly contoured and fitted inner sole.

The third modification of post op shoe 10 is illustrated in FIG. 6. The third modification provides a contoured inner sole 86 which is substituted for the planar inner sole 12. It may be desirable in certain instances to provide a slight contour to the inner sole to provide greater comfort for the wearer. Contoured inner sole 86 may be removably secured to platform 24. This permits the inner sole 86 to be formed to match a given foot size so that the inner sole 86 provides better support and assists the straps to position the metatarsal point 20 in the proper position. Inner sole 86 may be slightly curved upward ahead of the metatarsal point 20 to dorsiflex the foot and stabilize the medial ray of the foot. Two or three sizes of sole 86 for each of the four sizes of shoe 10 have been found to be most effective. Although the post op shoe 10 illustrated in FIGS. 1–3 is adapted for use by either the right or left foot, the inner sole 86 may be shaped to accept only the right or left foot to provide a better fit.

Of course, the post op shoe 10 may be provided with uppers of the conventional type if only one size foot need be accommodated. In addition, the portion of post op shoe 10 forward of fulcrum 16 may be constructed of a flexible material so that the toes 22 of the wearer may flex in the normal manner to a degree permitted by the particular ailment of the foot.

Figure 7:
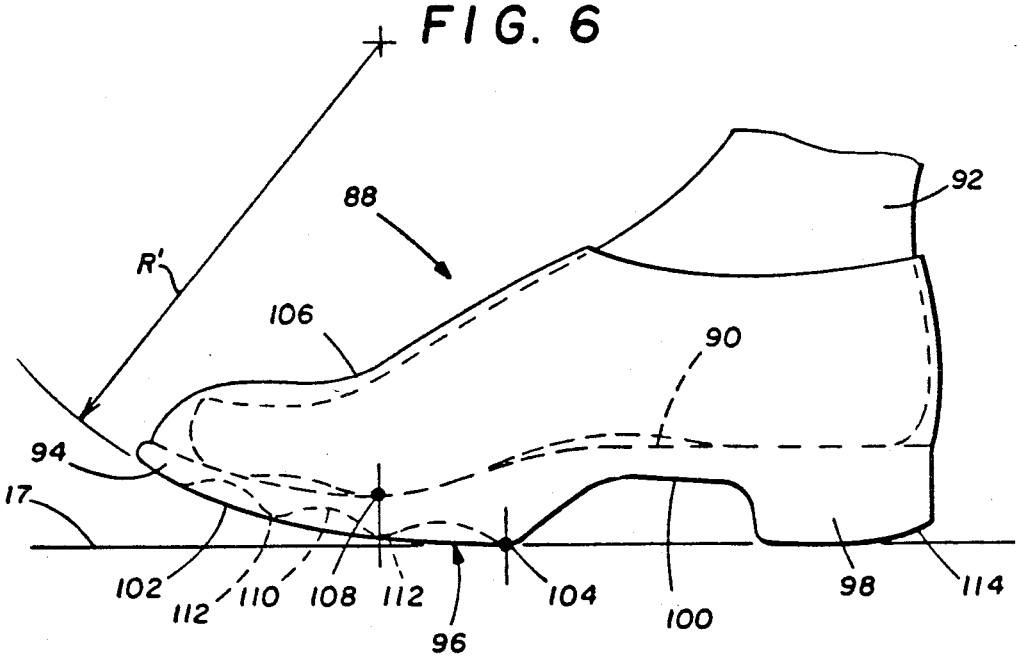
FIG. 7 is a side view of an orthopedic shoe forming the second embodiment of the present invention.

A second embodiment of the present invention is illustrated in FIG. 7 and comprises an orthopedic shoe 88. An inner sole 90 is provided which is fully contoured to receive a normal healthy foot 92. The platform 94 is formed of any common shoe material, such as leather, and is typically rigid or semi-flexible. The outer sole 96 has a heel portion 98, an instep 100 and a generally uniform radius curved surface 102. The intersection of instep 100 and curved surface 102 forms a fulcrum 104. A shoe upper 106 is provided which maintains and positions the foot 92 within shoe 88 as shown.

Again, as in post op shoe 10, the metatarsal point 108 of foot 92 is positioned forward of fulcrum 104 so that the natural cyclical motion of foot 92 in walking is simulated by shoe 88, pivoting about fulcrum 104 and rolling on curved surface 102 as the weight of the wearer is shifted onto the metatarsal point 108. The shear stresses typically found in a flexible shoe between the skin of the foot and the interior of the shoe are avoided by immobilizing foot 92 in the shoe 88 and then providing an external configuration to the outer sole 96 of shoe 88 to provide movements of shoe 88 that simulate the normal motion of walking in a flexible shoe. The inner sole 90 is preferably contoured to insure a slight dorsiflexion in foot 92 by curving the inner sole 90 upwardly from the portion supporting the metatarsal point 108 to the toe of shoe 88. This dorsiflexion provides stabilization of the medial ray of the foot. The radius of curvature R′ of the curved surface 102 is again chosen to provide a smooth transition in walking from the state where the body weight is supported on both heel portion 98 and fulcrum 104 to the state where the shoe 88 pivots about fulcrum 104. At the instant that the weight of the body is shifted to the metatarsal region, the shoe 88 begins to roll from the fulcrum 104 which is behind the metatarsal point 108 onto curved surface 102. As the center of mass of the body moves anterior to the weight bearing portion of the foot 92 the shoe 88 continues to roll along the rigid curved surface 102 until the foot 92 is lifted off the walking surface 17. The rolling action along the curved surface 102 provides a continuous change of pressure points on the forefoot of foot 92. This fact, along with the foot 92 being immobilized within shoe 88, negates the tendency to develop painful areas in the metatarsal region caused by prolonged and localized concentrations of stress as happens in a flexible shoe when the entire weight of the body is supported on the metatarsal point in the latter part of the walking motion. In a typical flexible shoe, the foot must flex a portion of the shoe in order to raise the heel of the foot off the ground. This requires energy input which causes fatigue. Since shoe 88 is rigid, no energy is employed to flex the shoe. In addition, as the shoe 88 rolls about the curved surface 102, the heel supporting surface of the inner sole 90 continues to support the heel of foot 92 so that the weight of the body is more evenly distributed along the sole of foot 92 than is possible with a flexible shoe. In one specific embodiment of the invention, a radius R′ of about 7¼ inches proved to be highly satisfactory.

Scalloped insets 110 are illustrated in phantom lines to indicate that the curved surface 102 may be formed with the scalloped insets, or any similar design, to enhance the attractiveness of shoe 88 while maintaining a generally curved surface formed by points 112 to ensure a smooth transition while walking. The heel portion 98 is shown with a curved rear portion 114 which may cushion the heel as it contacts the walking surface. The heel portion 98 of shoe 88 may be of any height or shape desired.

Although the shoe 88 is shown generally as a dress shoe having an Oxford type upper 106, the principles of the present invention may be applied to any common shoe such as a sandal, boot, moccasin or other form. The only necessary requirement is that the metatarsal point of the foot is positioned forward of the fulcrum point so that the shoe may pivot about the fulcrum point and roll on the curved outer sole forward of the fulcrum to simulate the natural motion of the foot in walking.

If desired, the heel of shoe 88 may be formed of a rubber solid ankle cushion heel (s.a.c.h.) In certain environments, a shoe is required to have a rigid toe guard, generally formed of steel, to protect the toes of the wearer. Such a toe guard can be incorporated with the shoe 88 so that the principles of the present invention may be employed in such an environment. It can be seen by contrasting the shoes illustrated in FIGS. 1 through 3 and 6 and 7 that the provision of a contoured inner sole will also permit the foot to be positioned closer to the walking surface 17 while maintaining the same pivoting action about the fulcrum. This feature lowers the center of gravity of the wearer to provide greater stability.

The basic purpose of the shoe 88 is to provide the maximum comfort with minimal stress for the feet of a normal, active individual. The platform 94, and soles 90 and 96 are rigid and nonflexible. The foot 92 is therefore put in a stable posture to accept the body weight and at the same time minimize stress on the soft tissues and ligaments of the foot. The vast majority of painful foot conditions are related to the forefoot and occur during the last half of the stance phase of the walking motion or cycle. During this phase, the metatarsal region of a single foot supports a weight even greater than the weight of the body. While walking in a standard, flexible shoe, a large number of individuals develop localized areas of both shear and direct pressure, resulting in painful callus formation. The design of shoe 88 is such that the foot 92 is placed in one position and does not significantly change this position during the walking motion as a result of the rigidity of the platform and soles of the shoe. This sleeve to lessen the shear stresses on the foot 92.

Figure 8:
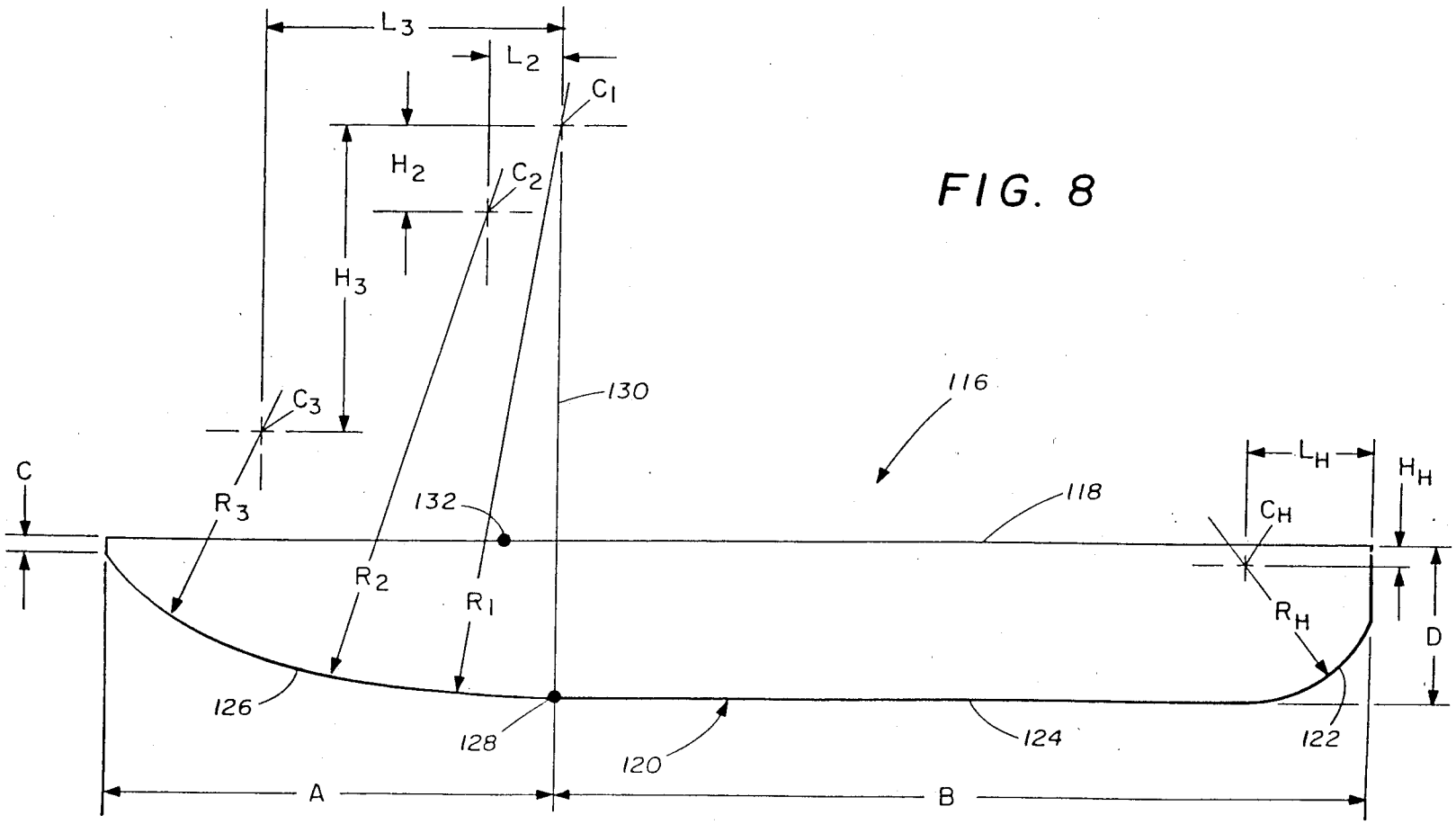
FIG. 8 is a side view of an orthopedic shoe forming a first modification of the second embodiment of the present invention.

A first modification of the second embodiment of the present invention is illustrated in FIG. 8 and comprises an orthopedic shoe 116. A planar sole 118 is provided, and may be contoured to receive a healthy foot. The outer sole 120 has a curved heel portion 122 having a radius of $R_H$, a planar portion 124 and a curved portion 126. The curved portion 126 is formed of three curves of progressively shorter radii, $R_1$, $R_2$ and $R_3$ towards the toe of the shoe 116. Again, as in the case with shoe 88, the inner sole 118, outer sole 120 and inner connecting structure are formed of relatively rigid or semi-flexible material. The intersection of the planar portion 124 and curved portion 126 defines a fulcrum 128.

A shoe upper, not illustrated, is provided which maintains and positions a foot on the inner sole 118 so that the metatarsal point of the foot is positioned forward of the fulcrum 128 and a vertical line 130 extending through the fulcrum. The metatarsal point of the foot may be positioned at point 132. In a typical application, point 132 may be positioned approximately $\frac{3}{8}$ inch or one centimeter forward of line 130. The shoe 116 also serves to maintain a foot placed in one position. This position does not significantly change during the walking motion as a result of the rigidity of the soles 118 and 120 of shoe 116.

The orthopedic shoe 116 simulates the natural cyclical motion of the foot in walking in a manner similar to shoe 88. However, the curved portion 126 of shoe 116 consists of the three curves of progressively shorter radii which are blended together to form a smooth curve. This design is critical during the portion of the walking motion referred to as "heel off", which is the portion of the motion where the body weight is transferred to the metatarsal bones of the foot and the heel is lifted off the ground. When this portion of the walking motion occurs, this shoe 116 is forced into a gentle rolling action on curved portion 126, thereby avoiding a continued, localized area of stress that would occur in a flexible shoe. In normal walking, the heel of a foot is lifted slowly at first and more rapidly toward the end of the stance phase. The progressively shorter radii on the more forward or toeward parts of the curved portion 126 allow for the increased speed of rolling or elevation of the heel of the foot as the stance phase is completed. It is this continuous, smooth progression which allows the inner sole 118 of shoe 116 to stay with the foot and support it throughout the walking motion.

In a specific embodiment of the invention as illustrated in FIG. 8, shoes were constructed in a range of sizes, arbitrarily referenced as sizes 1 through 5, for use on a foot across a broad range of foot sizes. The dimensions listed below in Table 1 prove to be highly satisfactory for each of these sizes.

TABLE 1

| Size | A (in.) | B (in.) | C (in.) | D (in.) | $L_2$ (in.) | $L_3$ (in.) | $L_H$ (in.) |
|---|---|---|---|---|---|---|---|
| 1 | 3.25 | 6.50 | .125 | 1.125 | .50 | 2.10 | .875 |
| 2 | 3.50 | 6.625 | .125 | 1.125 | .50 | 2.32 | .875 |
| 3 | 3.75 | 7.25 | .125 | 1.125 | .58 | 2.40 | .875 |
| 4 | 4.00 | 7.75 | .125 | 1.125 | .72 | 2.68 | 1.0 |
| 5 | 4.25 | 8.06 | .125 | 1.125 | .44 | 2.44 | 1.0 |

| Size | $H_2$ (in.) | $H_3$ (in.) | $H_H$ (in.) | $R_1$ (in.) | $R_2$ (in.) | $R_3$ (in.) | $R_H$ (in.) |
|---|---|---|---|---|---|---|---|
| 1 | 1.55 | 4.95 | .125 | 6.71 | 5.11 | 1.38 | 1.0 |
| 2 | 4.22 | 8.30 | .125 | 10.18 | 5.92 | 1.45 | 1.0 |
| 3 | 6.62 | 11.37 | .125 | 13.32 | 6.72 | 1.62 | 1.0 |
| 4 | 9.18 | 13.76 | .125 | 15.95 | 6.75 | 1.76 | 1.0 |
| 5 | 9.15 | 14.95 | .125 | 18.05 | 8.91 | 2.78 | 1.0 |

While specific embodiments of the present invention have been described in detail herein and shown in the accompanying drawings, it will be evident that various further modifications are possible without departing from the scope of the invention.

We claim:

1. A postoperative shoe for wear on a foot when walking on a surface comprising:

a planar inner sole having a first support face for supporting the heel of the foot and a second support face for supporting the metatarsal point of the foot;

an outer sole beneath and spaced from said inner sole having a first contact face beneath said first support face for contacting the surface and a second contact face having a fulcrum between said first and second support faces and extending from said fulcrum forward and toward said inner sole for contacting the surface, said first contact face and fulcrum contacting the surface when standing on the foot, the metatarsal point of the foot being supported forward of said fulcrum for initiating a rolling motion of the shoe on said second surface as weight is shifted to the metatarsal point of the foot in walking; and means for positioning and maintaining the foot supported on said first and second support faces of said inner sole;

the post op shoe further comprising a rigid platform interconnecting said inner sole and said fulcrum so that the natural motion of the foot in walking is simulated by said post op shoe rolling from said fulcrum on said second surface while the foot is supported on said inner sole without flexure.

2. The post op shoe of claim 1 wherein said means for positioning and maintaining the foot supported on said inner sole is adjustable to accommodate a range of foot sizes.

3. The post op shoe of claim 1 wherein said inner sole comprises a first layer and a second layer, said first layer adjacent the foot being formed of a closed cell cross linked polyethylene foam and said second layer adjacent said platform being formed of sponge rubber, said platform being formed of a nontoxic moldable plastic and having a nonskid surface secured thereto, said platform and said nonskid surface defining said outer sole.

4. The post op shoe of claim 2 wherein said means for positioning and maintaining the foot supported on said inner sole comprises:

first and second flexible side flaps secured at opposite edges of said platform for enclosing the upper foot;

first and second front straps secured at a first end to said first and second flexible side flaps, respectively, for positioning the foot supported on said inner sole, one of said flexible side flaps having a slot formed therein for passage of one of said front straps and said first and second front straps having means for securing the end opposite said first end of said first and second front straps on said second and first side flaps, respectively; and first and second heel straps secured at a first end to said first and second flexible side flaps, respectively, for maintaining the foot on said inner sole, one of said flexible side flaps having a slot formed therein for passage of one of said heel straps and said first and second heel straps having means for securing the end opposite said first end of said first and second heel straps on said second and first flexible side flaps, respectively.

5. The post op shoe of claim 4 wherein said means for positioning and maintaining the foot supported on said inner sole further comprises first and second cross straps secured to said platform at a first end adjacent said first support face, said first cross strap extending across said first flexible side flap and having means for securing the end opposite said first end on said second flexible side flap, said second cross strap extending across said second flexible side flap and having means for securing the end opposite said first end on said first flexible side flap, said first and second cross straps for maintaining the foot supported on said post op shoe.

6. The post op shoe of claim 1 wherein said inner sole is contoured to support a particular foot size and removable to selectively fit said post op shoe to a range of foot sizes.

7. A postoperative shoe for wear on a foot when walking on a surface comprising:

a planar inner sole having a first support face for supporting the heel of the foot and a second support face for supporting the metatarsal point of the foot;

an outer sole beneath and spaced from said inner sole having a first contact face beneath said first support face for contacting the surface and a second contact face having a fulcrum between said first and second support faces and extending from said fulcrum forward and toward said inner sole for contacting the surface, said first contact face and fulcrum contacting the surface when standing on the foot, the metatarsal point of the foot being supported forward of said fulcrum for initiating a rolling motion of the shoe on said second surface as weight is shifted to the metatarsal point of the foot in walking; and means for positioning and maintaining the foot supported on said first and second support faces of said inner sole, said second contact face including a curved face of generally uniform radius to provide a natural transition during walking from said first contact face and fulcrum contacting the surface to said curved face contacting the surface.

8. A post op shoe for wear on a foot when walking on a surface comprising:

a rigid platform having a top surface and a bottom surface, said top surface being substantially planar and said bottom surface formed by a first portion and a second portion, said first and second portions intersecting to form a fulcrum and said first portion extending from said fulcrum generally parallel said top surface and said second portion extending from said fulcrum towards said top surface;

a resilient inner sole secured to said top surface for cushioning the foot;

a nonskid material secured to said bottom surface for contacting the walking surface; and means for positioning and securing said post op shoe on the foot with the metatarsal point of the foot positioned forward of said fulcrum and above the second portion so that when the wearer is standing, the foot is supported on the walking surface through said first portion and when the wearer shifts weight onto the metatarsal point in walking, a rolling motion of said post op shoe on said second portion is initiated to simulate the motion of the foot in walking while maintaining the foot unflexed.

9. The post op shoe of claim 8 wherein said means for positioning and securing said post op shoe on the foot comprises:

first and second flexible side flaps secured at opposite edges of said platform for enclosing the foot;

inner and outer heel straps secured at a first end to said first and second flexible side flaps, respectively, said second flexible side flap having a slot formed therein for passage of said inner heel strap and said inner and outer heel straps having means for securing the end opposite said first end of said inner and outer heel straps on said second and first flexible side flaps, respectively; and means securing the first and second flexible side flaps over the front of the foot to position said post op shoe to the foot.

10. The post op shoe of claim 9 wherein said means securing the first and second flexible side flaps over the front of the foot comprise inner and outer front straps secured at a first end to said first and second flexible side flaps, respectively, said second flexible side flap having a slot formed therein for passage of said inner front strap and said inner and outer front straps having means for securing the end opposite said first end of said inner and outer straps on said second and first flexible sides, respectively.

11. The post op shoe of claim 10 wherein said means for positioning and securing said post op shoe on the foot further comprises first and second cross straps secured to said platform at a first end adjacent the heel, said first cross strap extending across said first flexible side flap and having means for securing the end opposite said first end onto said second flexible side flap, said second cross strap extending across said second flexible side flap and having means for securing the end opposite said first end on said first flexible side flap.

12. The post op shoe of claim 9 wherein said means securing the first and second flexible side flaps over the front of the foot comprise a plurality of eyelets positioned in said first and second flexible side flaps and a shoelace passing through said eyelets for tieing the flexible side flaps together.

13. The post op shoe of claim 9 wherein said means securing the first and second flexible side flaps over the front of the foot comprise first and second straps interconnected by a buckle.

14. The post op shoe of claim 8 wherein said second portion of said rigid platform is a curved surface having a generally uniform radius of curvature for providing a smooth transition from the foot being supported on said first portion to said second portion as said post op shoe rolls on said second portion as weight is shifted onto the metatarsal point.

15. The post op shoe of claim 8 wherein said resilient inner sole is contoured to cushion a particular foot size and removable to selectively fit said post op shoe to a range of foot sizes.

16. A post op shoe for wear on a foot for walking on a surface comprising:

a rigid member having a substantially planar upper surface and a lower surface having first and second portions, said first portion being substantially planar and parallel said upper surface, said second portion having a substantially uniform radius of curvature, said first and second portions forming a fulcrum at their intersection;

an inner sole secured to said upper surface for supporting the foot;

a nonslip covering secured to the lower surface of said rigid member to prevent slippage;

uppers comprising a first side flap and a second side flap secured at opposite sides of said rigid member for enclosing the foot;

a first front strap secured to said first side flap at one end and having means for removably attaching the opposite end of said first front strap to said second side flap at a selected position;

a second front strap secured to said second side flap at one end and having means for removably attaching the opposite end of said second front strap to said first side flap at a selected position, one of said side flaps having a slot therein to permit passage of one of said front straps therethrough, said first and second front straps positioning the foot so that a point directly above said fulcrum on said inner sole lies between the points supporting the heel and metatarsal point of the foot;

a first heel strap attached at one end to said first side flap and having means to removably secure the opposite end to a selected position on said second side flap;

a second heel strap attached at one end to said second side flap and having means to removably secure the opposite end to a selected position on said first side flap, one of said side flaps having a slot formed therein permitting one of said heel straps to pass therethrough, said first and second heel straps securing said post op shoe to the foot;

first and second cross straps secured at a first end to opposite sides of said rigid member adjacent the heel and extending along said first and second side flaps, respectively, said first and second cross straps having means to removably attach the ends opposite said first ends to the forward portion of said second and first side flaps, respectively; and the foot being positioned on said post op shoe with the metatarsal point of the foot forward of said fulcrum so that when the wearer is standing, the foot is supported on the walking surface through said first portion and when the wearer shift weights onto the metatarsal point in walking rolling motion of said post op shoe on said second portion is initiated to simulate the motion of the foot in walking while maintaining the foot unflexed, the substantially uniform radius of curvature of said second portion providing a smooth transition from supporting the foot on said first portion.

* * * * *